US010399357B2

(12) United States Patent
Haase et al.

(10) Patent No.: US 10,399,357 B2
(45) Date of Patent: Sep. 3, 2019

(54) THERMAL TRANSFER PRINTER AND CABLE TIE THEREFOR

(71) Applicant: HELLERMANNTYTON GMBH, Tornesch (DE)

(72) Inventors: Lukas Haase, Moorrege (DE); Patrick Stiewe, Lagerdorf (DE)

(73) Assignee: HELLERMANNTYTON GMBH (DE)

( * ) Notice: Subject to any disclaimer, the term of this patent is extended or adjusted under 35 U.S.C. 154(b) by 0 days.

(21) Appl. No.: 15/768,974

(22) PCT Filed: Oct. 21, 2016

(86) PCT No.: PCT/EP2016/075461

§ 371 (c)(1),
(2) Date: Apr. 17, 2018

(87) PCT Pub. No.: WO2017/068160

PCT Pub. Date: Apr. 27, 2017

(65) Prior Publication Data

US 2019/0061370 A1 Feb. 28, 2019

(30) Foreign Application Priority Data

Oct. 23, 2015 (DE) ..... 20 2015 007 411 U

(51) Int. Cl.
*B41J 2/325* (2006.01)
*B41J 3/407* (2006.01)
*B65D 63/10* (2006.01)

(52) U.S. Cl.
CPC ..... *B41J 2/325* (2013.01); *B41J 3/407* (2013.01); *B65D 63/10* (2013.01)

(58) Field of Classification Search
CPC ..... B41J 2/325; B41J 3/407; B65D 63/10
See application file for complete search history.

(56) References Cited

U.S. PATENT DOCUMENTS 3,887,965 A 6/1975 Schuplin
3,894,731 A 7/1975 Evans
5,042,181 A * 8/1991 Fortsch ..... G09F 3/14 292/307 R (Continued)

FOREIGN PATENT DOCUMENTS

CN 202670381 U 1/2013
CN 202728881 U * 2/2013 ..... B65D 63/12

(Continued)

OTHER PUBLICATIONS

Google translation of CN202897138U, published on Apr. 2013. (Year: 2013).*

(Continued)

*Primary Examiner* — Huan H Tran
(74) *Attorney, Agent, or Firm* — Robert J. Myers

(57) ABSTRACT

A thermal transfer printer having a pressing roll and a thermal printing head. The thermal transfer printer is configured to pass pre-aligned cable ties through a gap formed between the pressing roll and the thermal printing head and to imprint a labeling section of a respective cable tie by means of a transfer film likewise passed through the gap. The gap for passage of a respective cable tie head has a partial cross-sectional expansion in the feed-through direction through the gap.

30 Claims, 3 Drawing Sheets

(56) References Cited

U.S. PATENT DOCUMENTS

| | | | | |
|---|---|---|---|---|
| 5,329,302 | A | 7/1994 | Fogle et al. | |
| 5,511,892 | A | 4/1996 | Pickering | |
| 5,918,990 | A | 7/1999 | Abumehdi | |
| 6,277,456 | B1 | 8/2001 | Bulgrin et al. | |
| D781,692 | S * | 3/2017 | Lomax | D8/394 |
| 2004/0025386 | A1 | 2/2004 | Piana | |
| 2008/0007409 | A1 * | 1/2008 | Ferry | B29C 43/222 340/572.1 |

FOREIGN PATENT DOCUMENTS

| | | | | |
|---|---|---|---|---|
| CN | 202728991 | U | 2/2013 | |
| CN | 202897138 | U | 4/2013 | |
| DE | 2428262 | A1 | 1/1975 | |
| EP | 856409 | A2 | 8/1998 | |
| GB | 2290504 | A | 1/1996 | |
| JP | 5-200978 | * | 8/1993 | B41F 16/00 |
| JP | 7-45255 | * | 5/1995 | B41F 16/00 |

OTHER PUBLICATIONS

Ty-Rap/Ty-Fast Cable Fastening Systems catalog, Thomas & Betts Corporation, published in 2002. (Year: 2002).*

* cited by examiner

THERMAL TRANSFER PRINTER AND CABLE TIE THEREFOR

CROSS-REFERENCE TO RELATED APPLICATIONS

This application is a national stage application under 35 U.S.C. § 371 of PCT Application Number PCT/EP2016/075461 having an international filing date of Oct. 21, 2016, which designated the United States, said PCT application claiming the benefit of German Utility Model Application No. 20 2015 007 411.1, filed Oct. 23, 2015, the entire disclosure of each of which are hereby incorporated herein by reference.

TECHNICAL FIELD OF THE INVENTION

The present invention relates to a thermal transfer printer and a cable tie for use with the thermal transfer printer.

BRIEF DESCRIPTION OF THE SEVERAL VIEWS OF THE DRAWING

Characteristics and advantages of the invention shall appear upon reading the detailed description and the appended drawings, in which.

DETAILED DESCRIPTION OF THE INVENTION

Figure 1:
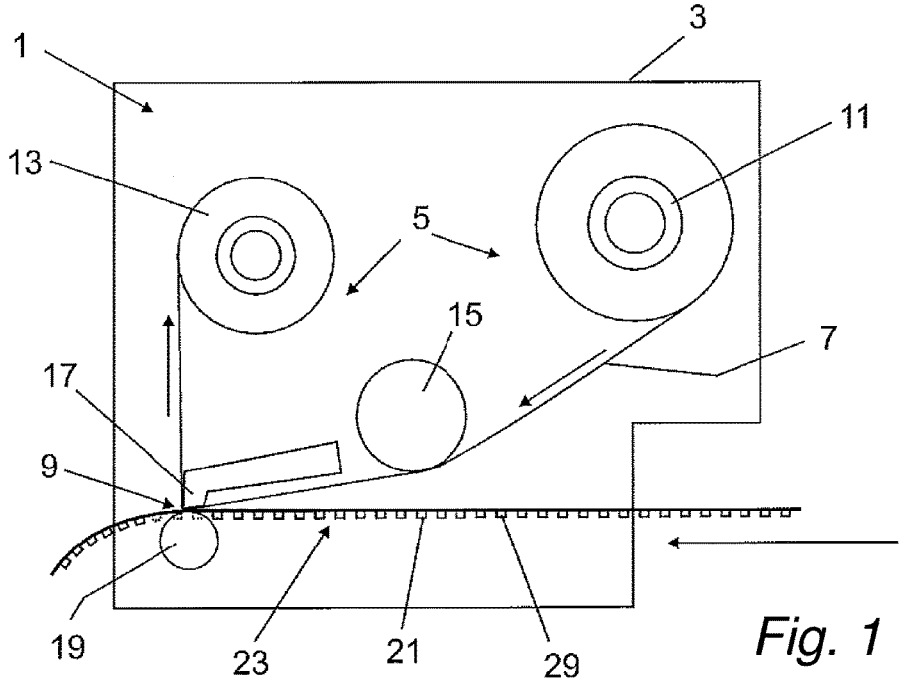
FIG. 1 shows a view of a thermal transfer printer with cable ties arranged thereon in accordance with one embodiment of the invention.

A thermal transfer printer with a pressing roll and a thermal printing head is presented. The thermal printing head, in particular extending strip-shaped in a printing gap direction, may have a plurality of separately controllable heating elements, in particular computerized controllable heating elements, to transfer a printed image to an object to be imprinted. The pressing roll, which in particular is arranged opposite the thermal printing head, in particular under joint formation of the (printing) gap, is provided to act upon objects to be imprinted with a designated contact force, in particular to transport the same. Preferably, the thermal transfer printer comprises a drive mechanism for the pressing roll, for example in the form of an electric motor.

The thermal transfer printer is further configured to pass the pre-aligned cable ties through the gap or printing gap formed between the pressing roll and the thermal printing head. In the preferred pre-alignment, the cable ties passing through the gap extend with their longitudinal extension direction in the longitudinal extension direction of the gap, i.e. the width direction of the cable ties corresponds to the feed-through direction through the gap. In this case, it is particularly desirable that the cable ties are received in the gap substantially over their entire length.

The thermal transfer printer may further comprise positioning means for positioning the cable ties with the intended pre-alignment at the gap or also conveying them to the gap. For example, the pressing roll may have carrier or engaging elements for this purpose. It is generally preferred, in particular with regard to a non-complex pre-alignment, to provide the cable ties to be imprinted belt-linked for use with the thermal transfer printer.

According to the invention it is envisioned to imprint a labeling section of a respective cable tie by means of the thermal transfer printer, for which a transfer film also passing through the gap is provided. The transfer film is a film coated with temperature-sensitive ink, which herein is passed between the thermal printing head and the cable ties through the gap—preferably as web. When a heating element of the thermal printing head is controlled and its head heated, the ink layer in the film is softened and can be transferred to the imprinting object (the cable tie), which is urged against the film by the pressing roll. An exact color imprint and a precise print quality can be achieved. A labeling section of a respective cable tie may be provided as labeling section, for example as tab, flag or as plate-shaped section.

In particular, in order to be able to guide the cable ties unhindered, but always reliably aligned and supported by the gap, in particular completely, thus allowing an optimum printing result, the gap in the presented thermal transfer printer further comprises a partial cross-sectional expansion for passage of a respective cable tie head in the feed-through direction through the gap. In this case, the partial cross-sectional expansion is formed in particular—viewed in the longitudinal extension direction of the gap—next to or outside that area which is overlapped by the transfer film in the gap. The thermal transfer printer according to the invention is thus advantageously able to imprint cable ties directly and precisely, so that affixing of imprinted labels onto the cable ties is no longer necessary.

Preferably, the partial cross-sectional expansion of the gap is formed by at least one recess on the thermal printing head, extending (in forming the gap) in longitudinal extension direction of the gap in particular strip-shaped, for example in a sheet thereof, alternatively, for example, by means of at least one recess on the pressing roll. Configurations are also conceivable in which both the thermal printing head and the pressing roll have a partial cross-sectional expansion for the passage of respective cable tie heads. In this case, a thermal transfer printer may be provided, in which respective cable tie heads may be aligned, as they pass through the gap, protruding in the direction of the pressing roll or protruding in the direction of the thermal printing head.

Simple embodiments of the thermal transfer printer provide that the partial cross-sectional expansion is formed by a groove at the pressing roll or by a groove in the thermal printing head. In this case, the groove at the pressing roll may be a groove in the circumferential direction of the same, i.e. a circumferential groove or annular groove, a groove in the thermal printing head, for example, a groove in the transverse direction of the gap or in the feed-through direction of the cable ties.

Preferred embodiments of the thermal transfer printer further provide that the thermal transfer printer at opposite end sections of the pressing roll or of the thermal printing head each have a recess to form a partial cross-sectional expansion for the passage of a cable tie head. In this case, the cable ties passing through the gap may be aligned such that the head of one cable tie points in the direction of a first longitudinal gap end and the head of a subsequently passing cable tie points in the direction of a second longitudinal gap end (i.e. the cable ties passing through the gap are offset by 180° to each other), so that the pre-alignment of the cable ties with regard to the space requirements, in particular belt-linked, can be carried out efficiently.

Further presented is a cable tie for use with a thermal transfer printer as discussed above, wherein the cable tie has a binding section and a labeling section wherein the binding section and the labeling section have the same thickness. With this embodiment of the cable tie, a maximized contact surface and optimum support when imprinted in the gap is achievable, thus allowing good print quality. In general, it may further be provided that the head of the cable tie is formed on the labeling section opposite the binding section, in particular forming a hinge joint.

With the cable ties which, as already noted, are preferably provided in belt-linked form, the belts preferably also have a height which corresponds to that of the binding section and the labeling section. As a result, the gap outside the partially expanded cross-section can be provided advantageously and structurally uncomplicated with a continuously uniform cross-section.

Further features and advantages of the invention will become apparent from the following description of embodiments of the invention, with reference to the figures of the drawings illustrating details essential to the invention, and from the claims. The individual features may be implemented individually for themselves or in a plurality of different combinations in a variant of the invention.

FIG. 1 shows, by way of example and schematically, a thermal transfer printer 1 having a printer housing 3, in which a film web transport device 5 is accommodated, by means of which a transfer film 7 may be conveyed through a printing gap or gap 9 of the thermal transfer printer 1. The film web transport device 5 comprises a first roll 11, which is provided for unwinding of the transfer film 7, further a second roll 13, which is provided for winding-up of the transfer film 7 after printing operation. A third roll 15 is provided to guide the transfer film web to the gap 9, with proper inclination being set, i.e. in the sense of a guide pulley.

The thermal transfer printer 1 further comprises a thermal printing head 17 which, together with a pressing roll 19 arranged underneath or opposite thereto, forms the gap 9 or printing gap. The gap 9 extends over the entire length of the pressing roll 19, i.e. the pressing roll 19 is overlapped over its entire length by the strip-shaped thermal printing head 17 extending over it to form the gap 9.

As can be seen, the guiding support of the transfer film 7 through the gap 9 is provided, which is deflected after passing through the 9—in the intended feed-through direction (arrows in FIG. 1)—at the thermal printing head 17 toward the second roll 13, i.e. for its wind-up.

In order to guide objects to be imprinted, in the present invention in particular cable ties 21 to be imprinted, toward or through the gap 9, i.e. between the transfer film 7 abutting against the thermal printing head 17 and the pressing roll 19, the pressing roll 19 is driven, for that the thermal transfer printer 1 comprises, for example, an electric drive unit (not shown). The cable ties 21 may further be supplied to the thermal transfer printer 1 by a feed device (not shown), for example by a supply roll or e.g. from a magazine. The feed device may be part of the thermal transfer printer 1 or e.g. be separate from it.

Figure 3:
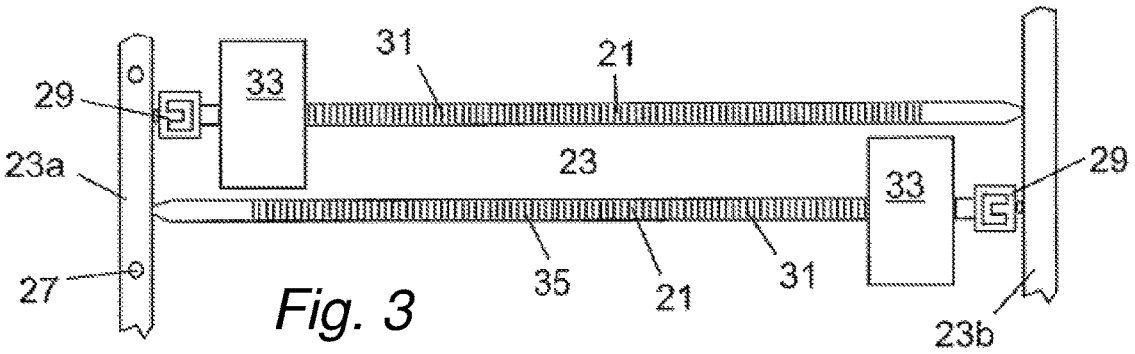
FIG. 3 shows a sectional view of cable ties which are belt-linked and to be imprinted with the thermal transfer printer; in accordance with one embodiment of the invention.

As illustrated in FIG. 3, the cable ties 21 to be imprinted are preferably joined or belt-linked to form a (continuous) strand 23, wherein the cable ties 21 are received in particular between two belts 23*a*, 23*b* and are each supported by it at their (longitudinal) end. Here advantageously, a 180° offset of successive cable ties 21 may reduce the longitudinal extent of the two belts 23*a*, 23*b* required for their reception. In addition, however, an individual supply of the cable ties 21 to the printing gap is conceivable, for example, a pre-alignment of a respective cable tie with a positioning device.

For the pre-alignment and the transport or passage through the gap 9, the pressing roll 19 comprises carrier elements 25 which are arranged on the edge in the form of e.g. engaging pins or cams. The carrier elements 25 may cooperate with corresponding engaging elements 27, for example recesses, of at least one belt 23*a*, i.e. to position the belt-linked cable ties 21 pre-aligned in the printing gap. A passage of the belt-linked cable ties 21 through the gap 9 is hereby provided in the longitudinal extension direction of the strand 23, wherein the longitudinal extension direction of the cable ties 21 coincides with the longitudinal extension direction of the gap 9.

As illustrated, for example, in FIG. 3, a respective cable tie 21 comprises a cable tie head 29 and a binding section 31, between which a labeling section 33 of the cable tie 21 is formed integrally with the cable tie head 29 and the binding section 31. Between the binding section 31 and the cable tie head 29 a hinge connection or a material taper may be provided, in particular to improve the flexibility of the cable tie 21. The labeling section 33 is provided as label field, for example, formed in a plate or tab form.

Figure 4:
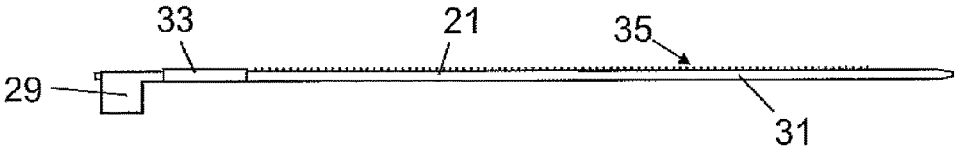
FIG. 4 shows a side view of the cable tie of FIG. 3 in accordance with one embodiment of the invention.

In the embodiment of the cable tie 21 according to FIGS. 3 and 4, it is provided as externally toothed cable tie 21, so that the toothed side 35 does not rest on a bundled material when being looped in. The cable tie head 29 of the cable tie 21 extends opposite to the toothed side 35 away from the plane of the binding section 31.

Figure 2:
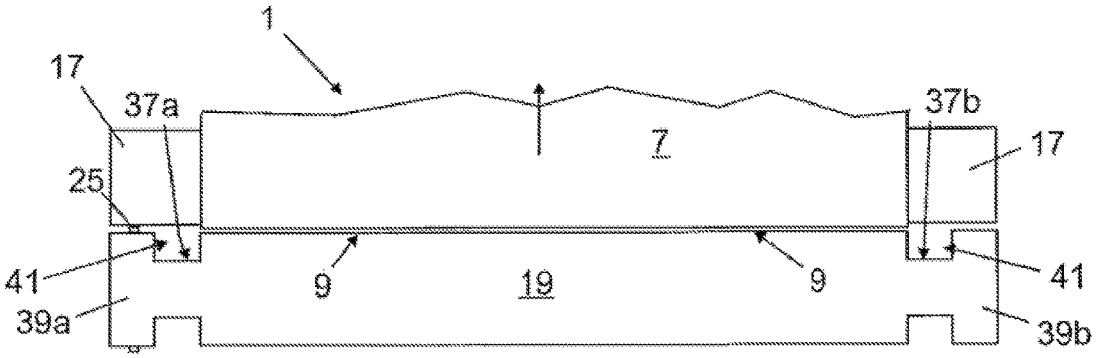
FIG. 2 shows a front view of the printing gap of a thermal transfer printer in accordance with one embodiment of the invention.

Particularly as illustrated in FIG. 2, in this embodiment according to the invention, the pressing roll 19 of the thermal transfer printer 1 further comprises a circumferentially extending groove 37*a*, 37*b* adjacent to a respective longitudinal end 39*a*, 39*b* such that the (printing) gap 9 formed by the pressing roll 19 is subject to a partial cross-sectional expansion 41. The partial cross-sectional expansion 41 causes, according to the invention, a respective cable tie head 29 to pass unhindered through the gap 9 in the feed-through direction.

As can be seen, the partial cross-sectional expansion 41 is further positioned such that a belt guide adjacent to the same is possible on longitudinal ends 39*a*, 39*b* of the pressing roll 19, and further an abutment of the labeling section 33 and the binding section 31 on the pressing roll 19 and the thermal printing head 17 over substantially the entire longitudinal extension of the cable ties, i.e. in the longitudinally central area of the pressing roll 19 between the partial cross-sectional expansion 41. It should be noted that the pressing roll 19 with the exception of the partial cross-sectional expansions 41 otherwise has substantially the same cross-section or diameter. Further, it should be noted that the transfer film 7 only overlaps the area of the pressing roll 19 between the partial cross-sectional expansion 41, see FIG. 2.

In particular, in connection with an embodiment of the cable ties 21 in such a way, see FIG. 4, that they have uniform thickness both over the labeling section 33 and over substantially the entire binding section 31, the cable tie 21 in the gap 9 may be firmly supported over almost its entire length with the thermal transfer printer 1, so that a precise and considerable print result is achievable. In the embodiment of the thermal transfer printer 1 according to FIGS. 1 and 2, in particular using the cable ties 21 shown in FIGS. 3 and 4 as discussed above, an imprint on the toothed side 35 is accomplished.

Figure 5:
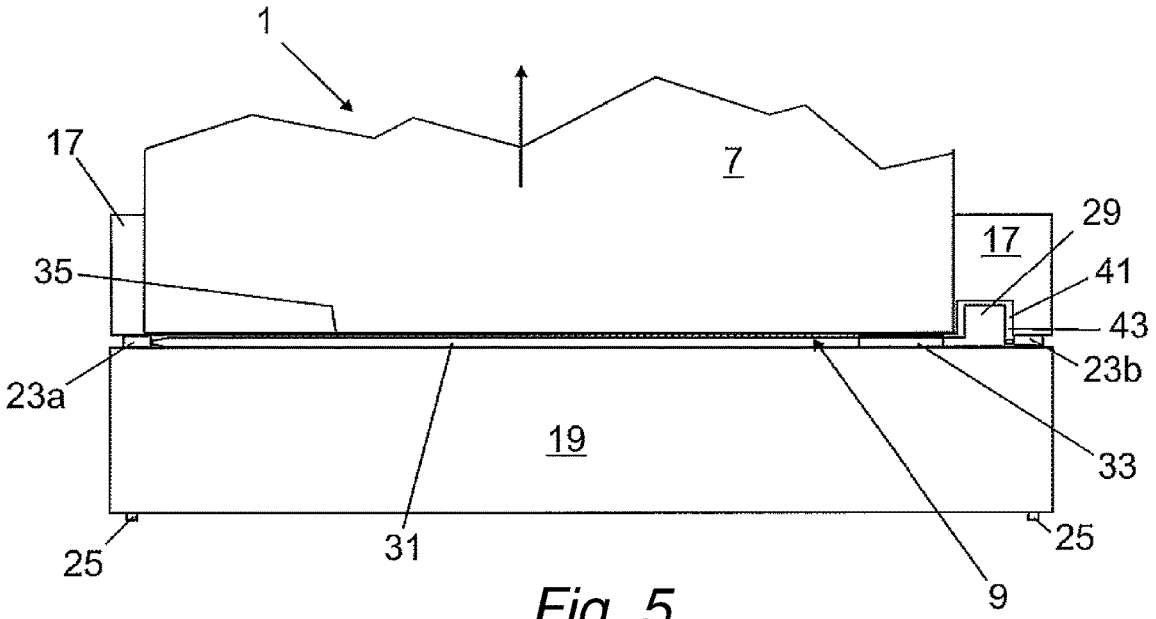
FIG. 5 shows a front view of the printing gap of a thermal transfer printer with cable tie received therein in accordance with one embodiment of the invention.

FIG. 5 illustrates another example embodiment of a thermal transfer printer 1 according to the invention, wherein, as in FIG. 2, the arrangement of pressing roll 19 and thermal printing head 17 is illustrated, in particular together with a cable tie 21 received in the gap 9 and the transfer film 7.

In contrast to the embodiment described above, with the thermal transfer printer 1 of FIG. 5, internally toothed cable ties 21 may be imprinted, in which the cable tie head 29 with the intended orientation for imprinting protrudes toward the thermal printing head 17. To enable the cable tie head 29 to pass unhindered through the gap 9, in this embodiment the thermal transfer printer 1 has a partial cross-sectional expansion 41 in the form of a groove 43 on the strip-shaped thermal printing head 17, which enables passage of the cable tie head 29 with the intended pre-alignment when imprinting. In this case, the groove 43 may extend in the feed-through direction of the cable ties 21 in the thermal printing head 17, i.e. as a longitudinal groove. Here, too, it is preferred that the binding section 31 and the labeling section 33 have the same thickness for uniform support in the gap 9, wherein here also the transfer film 7 does not overlap the partial cross-sectional expansion 41.

It should be noted that in the context of the present invention, other embodiments of a thermal transfer printer 1, although not explicitly shown, are conceivable and advantageous, which have a partial cross-sectional expansion 41 both by means of a recess in the pressing roll 19 and a recess in the thermal printing head 17. With such configurations, imprinting can optionally be achieved on externally and also on internally toothed types of cable ties 21 (the imprinting preferably being such that the labeling on the labeling section 33 is readable after application of the cable tie 21). Preferably, the cable ties 21 in the embodiment of the present invention may be made of plastic.

The invention claimed is:

1. A thermal transfer printer having a pressing roll and a thermal printing head, wherein the thermal transfer printer is configured to pass pre-aligned cable ties through a gap formed between the pressing roll and the thermal printing head and to imprint a labeling section of a respective cable tie by means of a transfer film likewise passed through the gap, wherein the gap for passage of a respective cable tie head has a partial cross-sectional expansion in the feed-through direction through the gap.

2. The thermal transfer printer according to claim 1, wherein the partial cross-sectional expansion of the gap is formed by means of at least one recess on the thermal printing head and/or at least one recess on the pressing roll.

3. The thermal transfer printer according to one of the preceding claims, wherein the partial cross-sectional expansion is formed by a groove on the pressing roll and/or by a groove in the thermal printing head.

4. The thermal transfer printer according to claim 1, wherein the partial cross-sectional expansion for the passage of a respective cable tie head is formed by means of recesses at opposite end sections of the pressing roll and/or the thermal printing head.

5. The thermal transfer printer according to claim 1, wherein the thermal transfer printer comprises positioning means for pre-alignment of the cable ties.

6. The thermal transfer printer according to claim 1, wherein the thermal transfer printer is configured to pass the cable ties belt-linked through the gap.

7. The thermal transfer printer according to claim 1, wherein the partial cross-sectional expansion is formed outside an area which is overlapped by the transfer film in the gap.

8. The thermal transfer printer according to claim 1, wherein the partial cross-sectional expansion is formed between an outer end of the gap and an area overlapped by the transfer film in the gap.

9. A cable tie for use with a thermal transfer printer according to claim 1, comprising:

a binding section;

a head configured to receive and retain the binding section; and a labeling section, wherein the cable tie is joined to one of two belts at each longitudinal end.

10. The cable tie according to claim 9, wherein the head is formed on the labeling section opposite the binding section, thereby forming a hinge joint.

11. A thermal transfer printer, comprising:

a pressing roll; and a thermal printing head, wherein a gap is formed between the pressing roll and the thermal printing head, said thermal transfer printer passing pre-aligned cable ties through the gap, said thermal transfer printer imprinting indicia on labeling sections of the pre-aligned cable ties by means of a transfer film likewise passed through the gap, wherein the gap has a partial cross-sectional expansion in the feed-through direction through the gap.

12. The thermal transfer printer according to claim 11, wherein the partial cross-sectional expansion of the gap is formed by a recess on the thermal printing head.

13. The thermal transfer printer according to claim 12, wherein the partial cross-sectional expansion of the gap is further formed by a recess on the pressing roll.

14. The thermal transfer printer according to claim 11, wherein the partial cross-sectional expansion is formed by a groove on the pressing roll.

15. The thermal transfer printer according to claim 14, wherein the partial cross-sectional expansion is further formed by a groove in the thermal printing head.

16. The thermal transfer printer according to claim 11, wherein the partial cross-sectional expansion for the passage of a respective cable tie head is formed by grooves at opposite longitudinal ends of the pressing roll.

17. The thermal transfer printer according to claim 16, wherein the partial cross-sectional expansion for the passage of a respective cable tie head is further formed by grooves at opposite longitudinal ends of the thermal printing head.

18. The thermal transfer printer according to claim 11, wherein the thermal transfer printer comprises a positioning means for pre-alignment of the cable ties.

19. The thermal transfer printer according to claim 18, wherein the positioning means includes a linking belt.

20. The thermal transfer printer according to claim 11, wherein the partial cross-sectional expansion is formed outside an area which is overlapped by the transfer film in the gap.

21. The thermal transfer printer according to claim 11, wherein the partial cross-sectional expansion is formed between an outer end of the gap and an area overlapped by the transfer film in the gap.

22. The thermal transfer printer according to claim 11, wherein the partial cross-sectional expansion of the gap is formed by a recess on the pressing roll.

23. The thermal transfer printer according to claim 11, wherein the partial cross-sectional expansion is formed by a groove in the thermal printing head.

24. The thermal transfer printer according to claim 11, wherein the partial cross-sectional expansion for the passage of a respective cable tie head is formed by grooves at opposite longitudinal ends of the thermal printing head.

25. A cable tie, comprising:

a binding section; and a labeling section, wherein the cable tie is joined to one of two belts at each longitudinal end.

26. The cable tie according to claim 25, wherein a cable tie head is formed on the labeling section opposite the binding section, thereby forming a hinge joint.

27. A cable tie assembly, comprising:

a plurality of cable ties, each cable tie having a binding section, a cable tie head configured to receive and retain the binding section, and a labeling section disposed between the binding section and the cable tie head; and a pair of elongate parallel belts, wherein each cable tie in the plurality of cable ties is attached to each of the pair of elongate belts at longitudinal ends of each cable tie.

28. The cable tie assembly according to claim 27, wherein at least one of the belts in the pair of elongate belts includes a recessed engaging element.

29. The cable tie assembly according to claim 27, wherein a first cable tie in the plurality of cable ties is offset by 180 degrees from a second cable tie in the plurality of cable ties.

30. The cable tie assembly according to claim 29, wherein the first cable tie is arranged adjacent the second cable tie.

* * * * *